US009064433B2

(12) United States Patent
Jumblatt et al.

(10) Patent No.: US 9,064,433 B2
(45) Date of Patent: Jun. 23, 2015

(54) COLOR CHANGING DISPLAYS

(75) Inventors: Nicholas L. Jumblatt, Louisville, KY (US); Eric W. Francke, Louisville, KY (US)

(73) Assignee: Jumbie, LLC, Louisville, KY (US)

( * ) Notice: Subject to any disclaimer, the term of this patent is extended or adjusted under 35 U.S.C. 154(b) by 0 days.

(21) Appl. No.: 13/169,648

(22) Filed: Jun. 27, 2011

(65) Prior Publication Data

US 2011/0314711 A1 Dec. 29, 2011

Related U.S. Application Data

(60) Provisional application No. 61/358,747, filed on Jun. 25, 2010.

(51) Int. Cl.

| | |
|---|---|
| ***G09F 13/00*** | (2006.01) |
| ***G09F 13/22*** | (2006.01) |
| ***G09F 13/18*** | (2006.01) |
| ***B65D 1/02*** | (2006.01) |
| ***G09F 19/20*** | (2006.01) |

(52) U.S. Cl.
CPC *G09F 13/18* (2013.01); *B65D 1/02* (2013.01); *B65D 2203/12* (2013.01); *G09F 19/20* (2013.01)

(58) Field of Classification Search
CPC ..... G09F 19/20; G09F 13/18
USPC ..... 40/564, 581, 577, 544
See application file for complete search history.

(56) References Cited

U.S. PATENT DOCUMENTS

| | | | | |
|---|---|---|---|---|
| 7,581,342 | B2 * | 9/2009 | Egami et al. | 40/444 |
| 7,685,753 | B2 * | 3/2010 | Slowski | 40/550 |
| 2006/0248761 | A1 * | 11/2006 | Cheung et al. | 40/564 |
| 2008/0236006 | A1 * | 10/2008 | Chadwell et al. | 40/581 |
| 2010/0288274 | A1 * | 11/2010 | Hudson | 128/202.13 |

* cited by examiner

*Primary Examiner* — Joanne Silbermann
(74) *Attorney, Agent, or Firm* — Stites & Harbison PLLC; Jeffrey A. Haeberlin; James R. Hayne

(57) ABSTRACT

A color changing display is provided that includes a frame structure having an inner surface, an outer surface, a front edge defining an open front portion of the frame structure, and a back edge defining an open back portion of the frame structure. A panel, having a front surface and a back surface, is attached to the back edge of the frame structure and covers the open back portion of the frame structure. One or more lights are secured to the inner surface of the frame structure and a light-transmitting substrate is attached to the front edge of the frame structure such that the light-transmitting substrate covers the open front portion of the frame structure. A combined image, comprising two or more images, is affixed to the light-transmitting substrate such that an appearance of the combined image changes in response to different colors of light.

16 Claims, 6 Drawing Sheets

COLOR CHANGING DISPLAYS

RELATED APPLICATIONS

This application claims priority from U.S. Provisional Application Ser. No. 61/358,747, filed Jun. 25, 2010, the entire disclosure of which is incorporated herein by this reference.

TECHNICAL FIELD

The presently-disclosed subject matter relates to color changing displays. In particular, the presently-disclosed subject matter relates to color changing displays that incorporate one or more lights to produce a color changing illumination and change the appearance of a combined image.

BACKGROUND

Individuals are increasingly being confronted with attention-getting displays and gimmicks that are put forth by various companies trying to sell their goods and services. Indeed, in recent years, the advertising industry has strived to not only make advertisements and displays bigger and brighter, but also flashier, more elaborate, and more interactive. However, these attempts by the advertising industry to make advertisements and displays "bigger and better" have led to a number of logistical and financial problems.

For example, some in the advertising industry have focused their efforts on constructing large interactive displays that include brightly-illuminated, high-definition screens. These displays are large enough to grab the attention of many individuals and are versatile in the sense that they can be used to display a number of different advertisements. However, these types of displays are often difficult to construct and are expensive to manufacture, operate, and maintain.

In this regard, others in the advertising industry have constructed displays that consist of large static or mechanical signage. While these later types of displays do not provide the versatility that is seen with high-definition screens, the static or mechanical displays are still effectively used as an advertising means as the displays are often well lit with white high-intensity discharge lighting. Inevitably, however, the use of high-intensity discharge lighting has made it expensive to provide these types of displays with sufficient electricity. As such, individuals in the adverting industry have now begun to use energy efficient light-emitting diodes (LEDs) as LEDs have a high lumen output and a distinctly low power consumption. Some advertisers have even begun to utilize colored LEDs, such as red-green-blue LEDs (RGB-LEDs), to incorporate various colors into a display.

To date, however, an advertisement or display has yet to be manufactured in which LEDs are effectively used as a secondary part of the display to project light onto an image and create a brighter and more interactive image in a display or advertisement. Instead, LEDs have merely been utilized as primary part of a display itself, either to light a fixed image or as a light in the display itself.

SUMMARY

The presently-disclosed subject matter relates to a color changing display that incorporates one or more lights to produce a color changing illumination and change the appearance of a combined image.

In one exemplary embodiment, a color changing display is provided that includes a frame structure having an inner surface, an outer surface, a front edge that defines an open front portion of the frame structure, and a back edge that defines an open back portion of the frame structure. The color changing display further includes a panel having a front surface and a back surface, where the panel is attached to the back edge of the frame structure and covers the open back portion of the frame structure. Additionally, one or more lights are secured to the inner surface of the frame structure, the front surface of the panel, or both, and a light-transmitting substrate is attached to the front edge of the frame structure such that the light-transmitting substrate covers the open front portion of the frame structure. A combined image, comprising two or more images, is further affixed to the light-transmitting substrate such that an appearance of the combined image changes in response to different colors of light.

To control the one or more lights in the color-changing display, a controller is secured to the front surface of the panel and is connected to the one or more lights. In this regard, in some embodiments, a power supply is further secured to the front surface of the panel such that it is connected to the controller and supplies power to the controller and lights.

With respect to the lights of the presently-described color changing displays, in certain embodiments, the lights in an exemplary color changing display can be mounted at an angle such that the light being emitted is directed toward a desired portion of the light-transmitting substrate. In some embodiments, the color changing display further includes a mounting lip that is secured around the inner surface of the frame structure and the front surface of the panel for mounting the one or more lights at the desired angle.

With further respect to the lights of the presently-described color changing displays, the one or more lights that are included in the displays are typically comprised of a red light, a green light, and a blue light. For example, in some embodiments, the one or more lights comprise red-green-blue light-emitting diodes (RGB-LEDs) that, in certain embodiments, are arranged in strips of RGB-LEDs. In this regard, in some embodiments, the color-changing display includes two strips of RGB-LEDs that are arranged in two rows around the inner surface of the frame structure. In certain embodiments, the one or more lights are addressable such that certain of the lights can emit one desired color while other lights are emitting different colors. Further, in certain embodiments, the one or more lights are arranged in a matrix (e.g., a matrix of addressable RGB-LEDs) where the color of each light in the matrix can be controlled independently.

The light-transmitting substrates included in the color changing displays of the presently-disclosed subject matter can be comprised of a number of different materials, such as paper, glass, translucent vinyl, and plexiglass. In certain embodiments, the light-transmitting substrate is a substrate that is configured for diffuse transmission such that light being transmitted from the lights of the display is spread and scattered throughout the surface of the light-transmitting substrate, and is thus transmitted evenly through the light-transmitting substrate.

In further embodiments of the presently-disclosed subject matter, a color changing display is provided in the form of a color changing bottle. In some embodiments, a color changing bottle is provided that includes: a bottle having a compartment positioned in a lower portion of the bottle; a light (e.g., an RGB-LED) secured within the compartment for producing a color changing illumination; a light-transmitting substrate that is attached to the bottle such that the light transmitting substrate surrounds at least a portion of the bottle; and a combined image that comprises two or more images affixed to the light transmitting substrate such that an appearance of the combined image changes in response to different colors of light. An exemplary color changing display can further include a controller that is secured within the compartment for controlling the light, and a power supply that is secured within the compartment and connected to the controller.

In some embodiments, a color changing bottle further includes a switch that is positioned on the bottom of the bottle such that placement of the bottle on a surface activates the switch. In some embodiments, the color changing bottle include a magnifier that is positioned above the light. In this regard, in certain embodiments, the magnifier is used to focus light upward into a body of the bottle and onto the light-transmitting substrate that, in some embodiments, is in the form of a label that is attached to an exterior surface of the bottle.

Still further provided, in some embodiments of the presently-disclosed subject matter, are color changing displays that are incorporated into various vending machines, such as soft drink vending machines. In some embodiments, a color changing vending machine is provided that includes: a vending machine having a light-transmitting display surface; one or more lights secured to an interior portion of the vending machine for producing a color changing illumination; and a combined image comprising two or more images affixed to the light-transmitting display surface such that the appearance of the combined image changes in response to different colors of lights. In some embodiments, the color changing vending machines can additionally include a controller for controlling the one or more lights; and a power supply connected to the controller. In some embodiments, the one or more lights included in the vending machines are red-green-blue light-emitting diodes (RGB-LEDs) that, in certain embodiments, are arranged in a matrix.

Further features and advantages of the present invention will become evident to those of ordinary skill in the art after a study of the description, figures, and non-limiting examples in this document.

DESCRIPTION OF EXEMPLARY EMBODIMENTS

The presently-disclosed subject matter relates to color changing displays. In particular, the presently-disclosed subject matter relates to color changing displays that incorporate one or more lights to produce a color changing illumination and change the appearance of a combined image.

Figure 1:
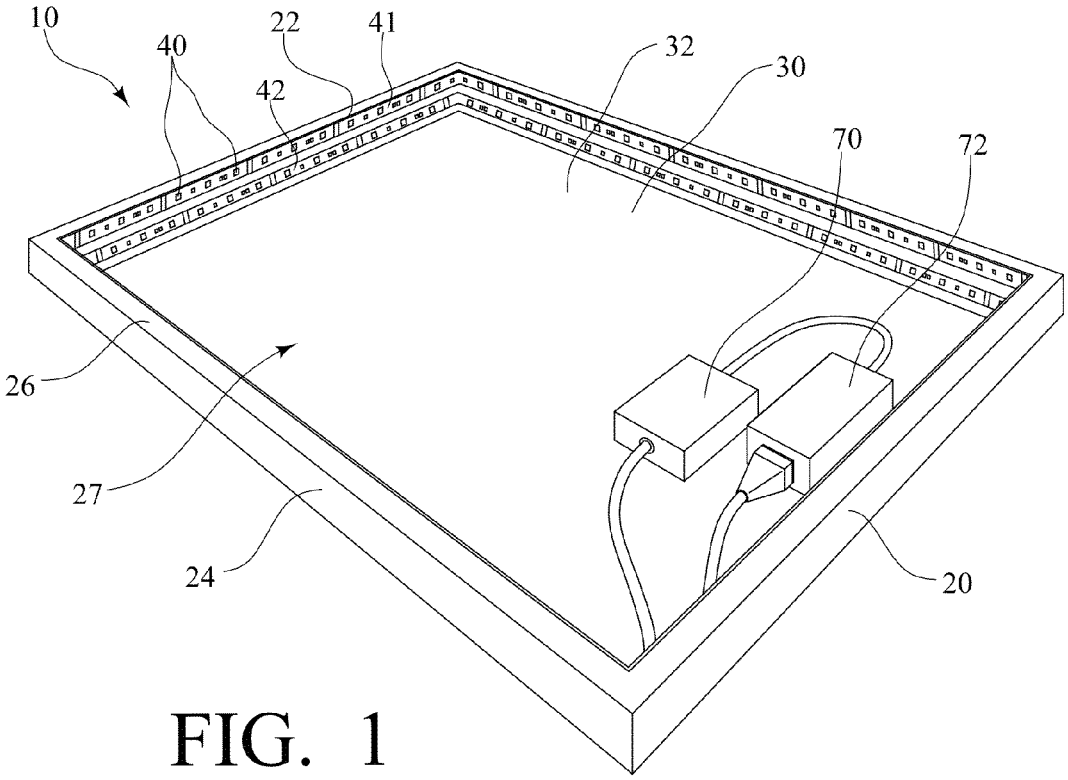
FIG. 1 is a perspective view of an exemplary color changing display made in accordance with the presently-disclosed subject matter, but without a light-transmitting substrate affixed to a front edge of the frame structure.
Figure 2:
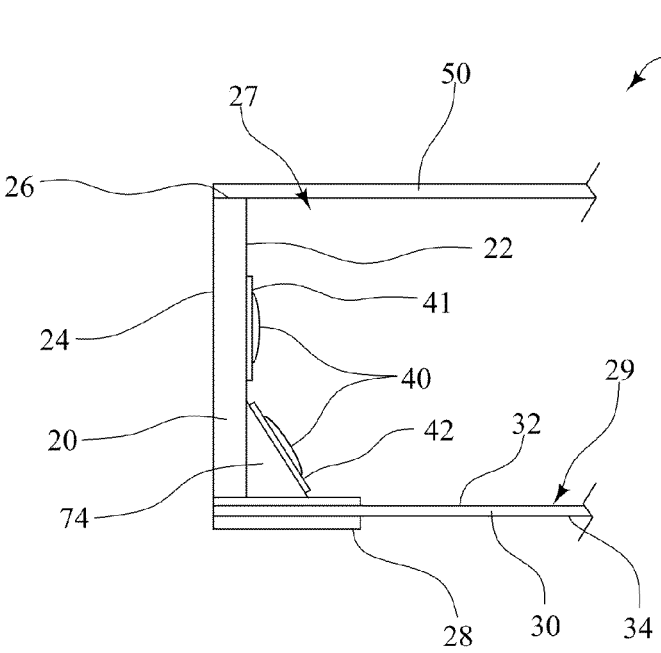
FIG. 2 is a partial cross-sectional view of the exemplary color changing display shown in FIG. 1, illustrating lights secured to a mounting lip and inner surface of the frame structure and further illustrating a light-transmitting substrate affixed to the front edge of the frame structure.

Referring first to FIGS. 1 and 2, in one exemplary embodiment of a color changing display 10 made in accordance with the present invention, the color changing display 10 includes a frame structure 20 that can be fabricated from a variety of materials including wood, plastic, and/or metal. The frame structure 20 includes an inner surface 22, an outer surface 24, a front edge 26 defining an open front portion 27 of the frame structure 20, and a back edge 28 defining an open back portion 29 of the frame structure 20. The color changing display 10 further includes a panel 30 having a front surface 32 and a back surface 34. The panel 30 is attached to the back edge 28 of the frame structure 20 such that the panel 30 covers the open back portion 29 of the frame structure 20. Typically, the panel 30 and, in particular the front surface 32 of the panel 30, is comprised of a material that is light in color, or that can readily be painted with a light color, such that any light being emitted within the color changing display 10 is reflected by the panel 30, as described in further detail below.

The color changing display 10 also includes one or more lights 40 that are secured to the inner surface 22 of the frame structure 20, the front surface 32 of the panel 30, or both. The lights 40 are used to produce a color changing illumination that can be directed toward a light-transmitting substrate 50. As shown in FIG. 2, the light-transmitting substrate 50 is attached to the front edge 26 of the frame structure 20 such that the light-transmitting substrate 50 covers the open front portion 27 of the frame structure 20. A variety of materials can be used as a light-transmitting substrate 50 in accordance with the presently-disclosed subject matter including, but not limited to, paper, glass, translucent vinyl, lenticular substrates, or plexiglass. In some embodiments, the light-transmitting substrate 50 is a substrate that is configured for diffuse transmission such that light being emitted from the lights 40 is spread and scattered throughout the surface of the light-transmitting substrate 50 and is thus transmitted evenly through the light-transmitting substrate 50.

As shown in FIG. 1, the color changing display 10 further includes a controller 70 and a power supply 72, both of which are secured to the front surface 32 of the panel. In this regard, the controller 70 can be operably connected to the lights 40 and used to control the amount and the color of the light that is being emitted from the lights 40. Of course, the power supply 72 is connected to the controller 70 and is used to provide power to the lights 40 and the controller 70. As would be recognized by those of ordinary skill in the art, any suitable power supply can be used in accordance with the presently-disclosed subject matter including, but not limited to, battery packs, AC/DC adapters, and the like. In some embodiments, the controller 70 and power supply 72 are housed in a compartment (not shown) of the frame structure 20 such that the compartment can slide outward and downward to allow an individual to view, access, and manipulate the controller 70, the power supply 72, and any other component of the color changing display 10.

Figure 3A:
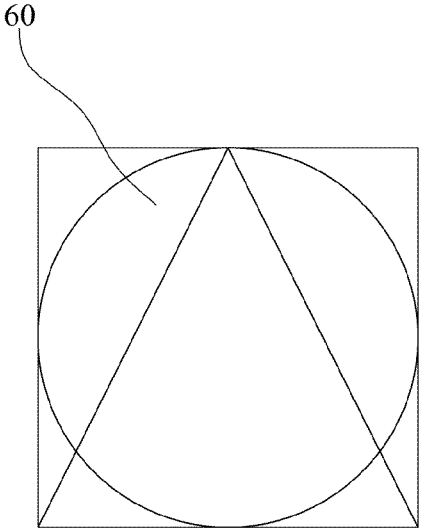
FIGS. 3A-3D include schematic representations of an exemplary combined image that can be affixed to a light-transmitting substrate in accordance with the presently-disclosed subject matter, including a schematic representation of the image exposed to white light (FIG. 3A), a schematic representation of the image under red light (FIG. 3B), a schematic representation of the image under green light (FIG. 3C), and a schematic representation of the image under blue light (FIG. 3D).
Figure 6:
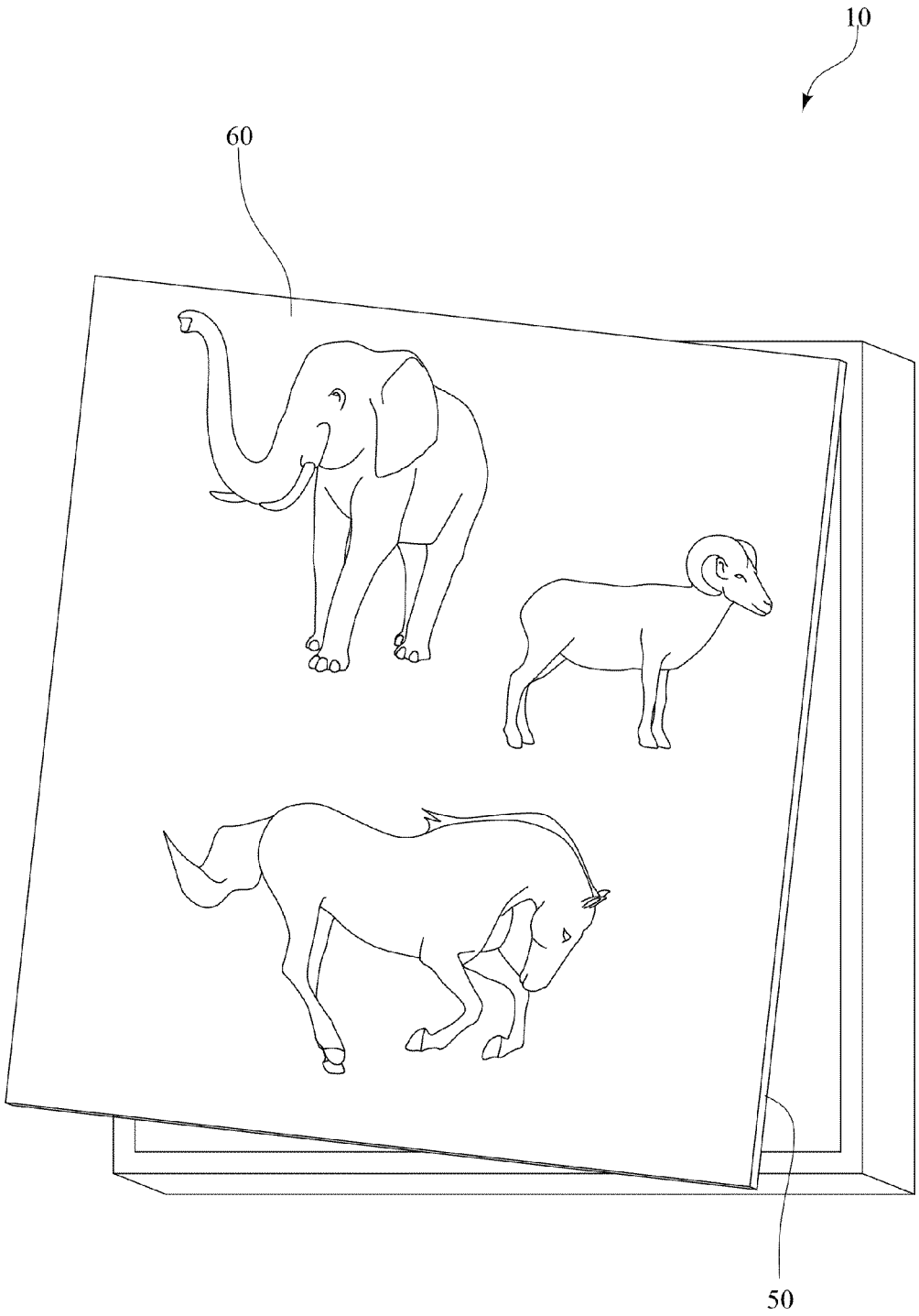
FIG. 6 is a photograph of another exemplary combined image affixed to a light-transmitting substrate.

Finally, as shown in FIGS. 3A and 6, the color changing display 10 further includes a combined image 60 that is comprised of two or more images and is affixed to the light-transmitting substrate 50. In some embodiments, the combined image 60 can be created and affixed to the light-transmitting substrate by first creating two or more digital images using various digital photo-editing and/or three-dimensional computer software programs (e.g., ADOBE PHOTOSHOP® or AUTODESK® MAYA®). In this regard, the images that are created can be images that are obtained from various media, including drawings, paintings, or photos, and can be made to include assorted colors with varying opacities. Furthermore, by using various digital photo-editing and/or three-dimensional computer software programs, the images can further be made to have assorted textures that are apparent upon printing the images.

As one exemplary method for producing a combined image 60 that can be used in accordance with the presently-disclosed subject matter, in some embodiments, an artist can utilize various brushes and graphic design tools, available on computer software, to produce layered effects. In this regard, the artist can shade and saturate objects with color to form various stylized, digital images that include contrasting colored layers, but yet are still high-definition images that are clear at high resolutions such that the layers appear three-dimensional. Furthermore, in producing the combined image 60, the artist can also cause different layers of the images to have different opacities such that seemingly translucent layers can be created in the images with multiple pigments overlaying one another. Using such techniques, the digital image can achieve the appearance of multiple visible layers on any desired surface upon subsequent printing. Of course, when the digital image is complete, it can also be formatted and flattened such that it can be printed as a single layer.

Regardless of the particular images that are created and/or selected, however, once the images are created and/or selected, the images are then printed. In some embodiments, the combined image 60 is printed using RGB (red, green, blue) printing, as opposed to CMYK (cyan, magenta, yellow, black) printing, to provide a broader spectrum of colors that are capable of reacting with the light being emitted from the lights 40 such that the appearance of the combined image 60 changes in response to different colors of light, as discussed in further detail below. In some embodiments, an ultra-violet (UV) coating can subsequently be applied to the printed image to create a glossy finish that causes the combined image 60 to appear to glow when it is illuminated by the lights 40.

Once the combined image 60 is printed, it is then mounted, framed, or otherwise affixed on top of the light-transmitting substrate 50. In some embodiments, which make use of a digitally photo-developed transparency as the printing material for the combined image 60, the transparency can be affixed to the light-transmitting substrate and then an exterior protective panel (not shown) made of glass, plexiglass, or a like material can be used to cover the combined image 60. In another embodiment wherein the frame structure is comprised of a plastic material, the light transmitting substrate 50 can further include a thin, clear plastic sleeve into which the combined image 60 is easily inserted and removed such that the combined image 60 can readily be changed as desired.

As noted above, the lights 40 of the color changing display 10 are used to produce a color changing illumination that is directed toward the light-transmitting substrate 50. In this regard, when the combined image 60 is affixed to the light-transmitting substrate 50 and various colors of light are projected onto the light-transmitting substrate 50 and the combined image 60, the various colors of light (e.g., red, green, and blue) react with the layers of the combined image 60 and produce a moving, holographic effect. In some embodiments, when light is projected onto the light-transmitting substrate 50 and the combined image 60 and then transitions from color to color, the transition of light creates a visual effect because the pigment colors are either reflecting or absorbing the different colors of light. For example, in an exemplary combined image 60, an area of green pigment in the combined image 60 will reflect green light, and will absorb light from the red and blue end of the color spectrum. As such, when the light being produced by the lights 40 is a pure green light, the green area of pigment will be visible. However, when the light being emitted by the lights 40 is from the pure blue and pure red ends of the spectrum, the green pigmented area will appear as black or otherwise seem to disappear from the combined image 60. Using this transition of light, the combined image 60 of the color changing display 10 can thus be made to appear to have movement, depth, and animation, even though the combined image 60 is printed on a flat, static surface.

Figure 3B:
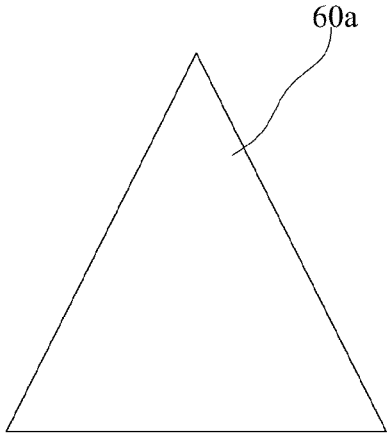
Figure 3C:
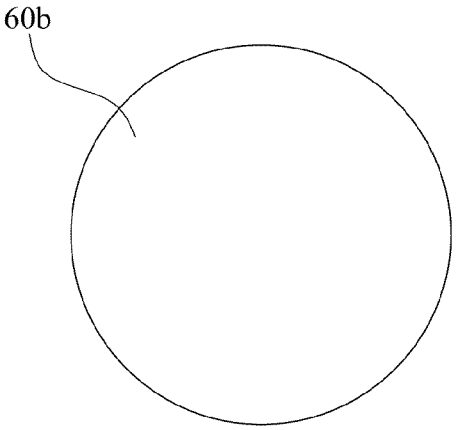
Figure 3D:
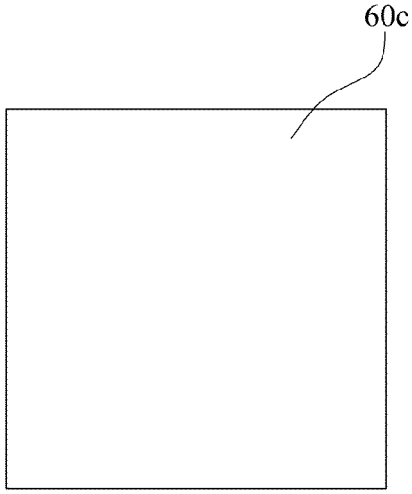

Referring now to FIGS. 3A-3D, as an example of how the presently-disclosed color changing display 10 can be utilized to seemingly create movement, depth, and animation on a flat, static surface, a combined image 60 can first be digitally created and printed such that the combined image 60 includes three layered (i.e., overlapping) shapes of different colors, namely a red triangle 60*a*, a green circle 60*b*, and a blue square 60*c*. When this image is subsequently illuminated by a white light, all three shapes are visible in their respective colors with some sections of the shapes being partially or entirely covered by one or more of the other shapes, as shown in FIG. 3A, because the combined image is exposed to a full-spectrum of light, allowing each of the colors of the respective shapes to be reflected and perceived. However, when the color of the light being emitted from the lights 40 is changed such that only red light is being emitted, only the red triangle 60*a* will appear visible as the red triangle 60*a* is reflecting red light and the green circle 60*b* and blue square 60*c* are absorbing the red light, as shown in FIG. 3B. Similarly, as shown in FIGS. 3C and 3D, when the color of emitted light is changed such that only green light or blue light is being emitted, only the respective green circle 60*b* or blue square 60*c* will be visible. In this regard, the color of the light being emitted from the lights 40 can be transitioned from color to color to allow the shapes to appear and disappear and, consequently, create a combined image 60 that appears to have depth, movement, and/or animation. Of course, the exemplary application described above is only representative of one possible application of the presently-disclosed color changing display 10. As would be recognized by those of ordinary skill in the art, the above-described techniques can readily be utilized with a variety of layered images, shapes, and color schemes to create a multitude of seemingly holographic and/or animated images, such as the exemplary combined image 60 shown in FIG. 6 that may include a red elephant, a green horse, and a blue pig. Additionally, the technique described above can further be utilized with a combined image that includes text such that the technique can be used to make certain text appear, disappear, and/or reappear depending on the pigment color used to produce the text and the color of the light being emitted from the lights 40.

With further regard to the lights 40 of the color changing display, and referring again to FIGS. 1 and 2, one or more of the lights 40 are typically mounted at an angle in the color changing display 10 such that some of the light being emitted is directed toward a desired portion (e.g., the middle) of the light-transmitting substrate 50. Applicants have discovered that by positioning the lights 40 in the color changing display 10 at such an angle, it is possible to avoid the combined image 60 having a center portion that appears darker than the surrounding portions of the combined image 60, such as what may otherwise occur if the lights are flatly mounted on only the inner surface 22 of the frame structure 20.

In some embodiments, to achieve the desired angle of light, a mounting lip 74 is further included in the color changing display 10 and is secured around the inner surface 22 of the frame structure 20 and the front surface 32 of the panel 30 such that the mounting lip 74 secures the one or more lights 40 at the desired angle. In some embodiments, the mounting lip 74 can be comprised of a piece of quarter-round molding that is installed in the color changing display 10 such that the emitted light contacts the light-transmitting substrate 50 and the combined image 60 at an angle of about 60° to about 70°. Of course, the materials used to create the mounting lip 74, as well as the desired angle at which the light contacts the light-transmitting substrate 50 and the combined image 60, can readily be changed for a particular combined image 60 or for a particular application without departing from the spirit and scope of the subject matter described herein.

Figure 4:
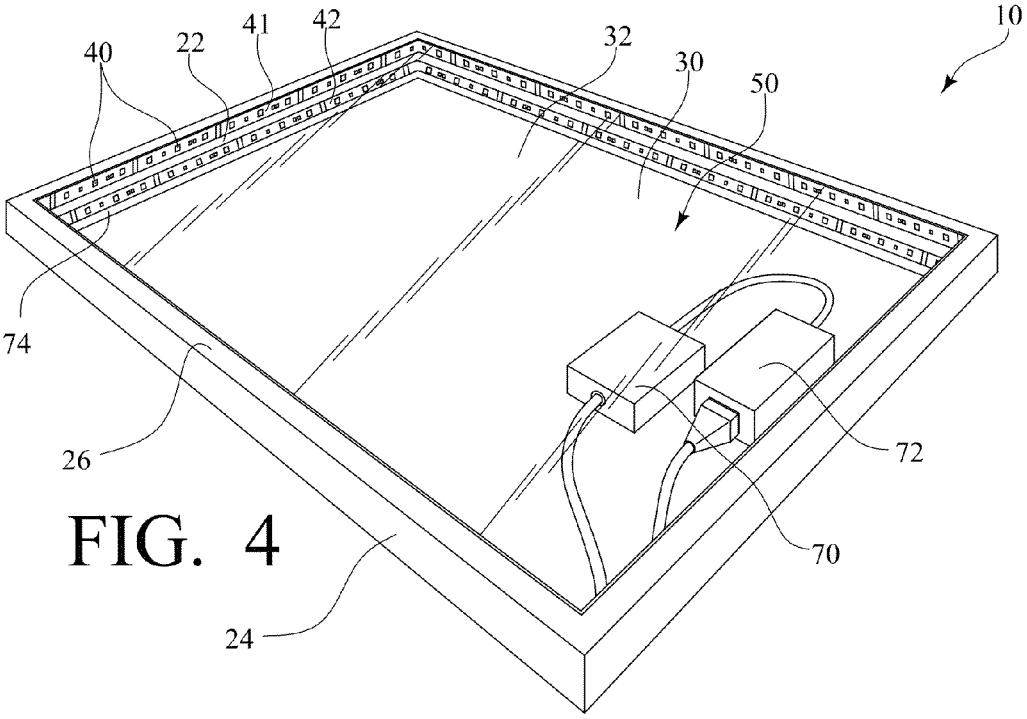
FIG. 4 is a photograph of an exemplary color changing display made in accordance with the present invention, but without a combined image affixed to the light-transmitting substrate.
Figure 5:
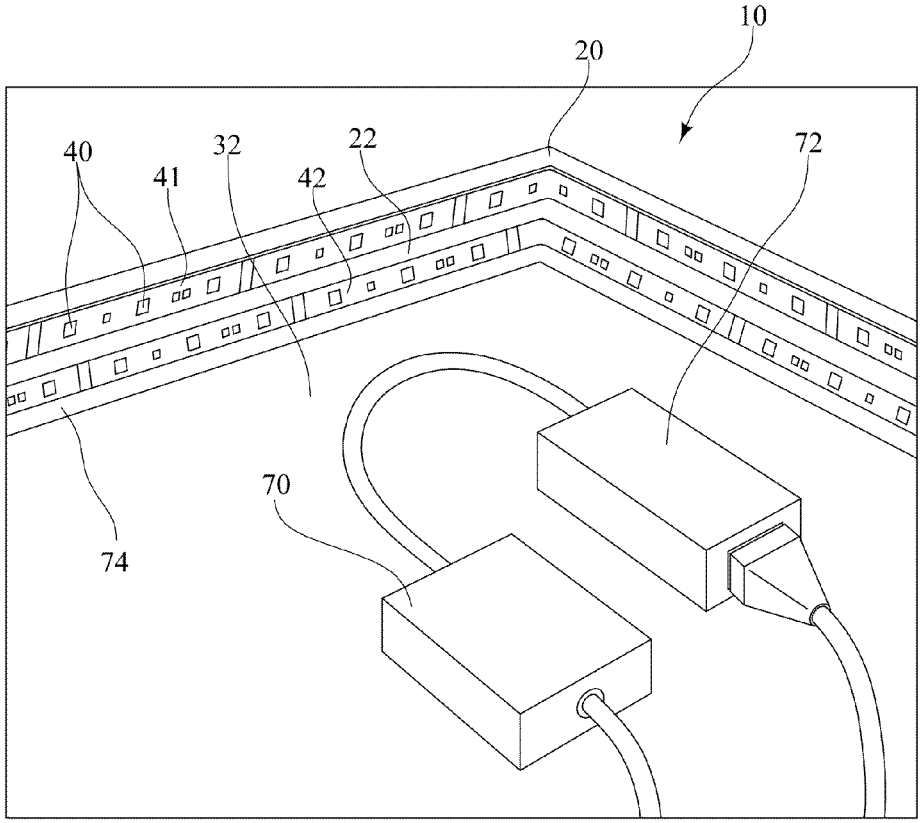
FIG. 5 is a photograph of a portion of the exemplary color changing display shown in FIG. 4, showing a controller and a power source secured to the front surface of the panel of the color changing display.

With further regard to the lights 40 of the color changing display, and referring now to FIGS. 4 and 5, in some embodiments, the one or more lights 40 are comprised of a red-green-blue light-emitting diode (RGB-LED), which is comprised of one red, one blue, and one green diode. By using the RGB-LEDs in the color changing display 10, it has been found that the light being emitted from the RGB-LEDs can effectively be used to smoothly transition the light emitted from the lights 40 between the pure colors of the full-spectrum of light, and thus create an appearance that the combined image 60 is fading from one image to the next. Specifically, it has been found that by varying the voltage to each colored diode of the RGB-LED, the voltage to one colored diode can be decreased, while the voltage of the next diode is increased proportionally to thereby provide a smooth transition between colors.

In some embodiments, the RGB-LEDs are arranged in strips of RGB-LEDs 41, 42, as shown in FIGS. 4 and 5. In some embodiments, these strips of RGB-LEDs 41, 42 are further arranged in two rows around the inner surface 22 of the frame structure 20, with one strip 42 being positioned on a mounting lip 74 and one strip 41 being positioned directly on the inner surface of the frame structure. Furthermore, in some embodiments, the one or more lights 40, such as the RGB-LEDs, can be addressable such that certain of the lights 40 emit one desired color while one or more other lights 40 are emitting different colors.

In some embodiments of the presently-disclosed color changing display 10, the lights 40 comprise an addressable matrix of RGB-LEDs, where the color of each RGB-LED can be controlled independently. Exemplary RGB-LEDs that can be used to produce an addressable matrix of RGB-LEDs include RGB 3-W 10.6×10 mm SMT AstraLEDs (Lumex, Inc., Palatine, Ill.).

Figure 7:
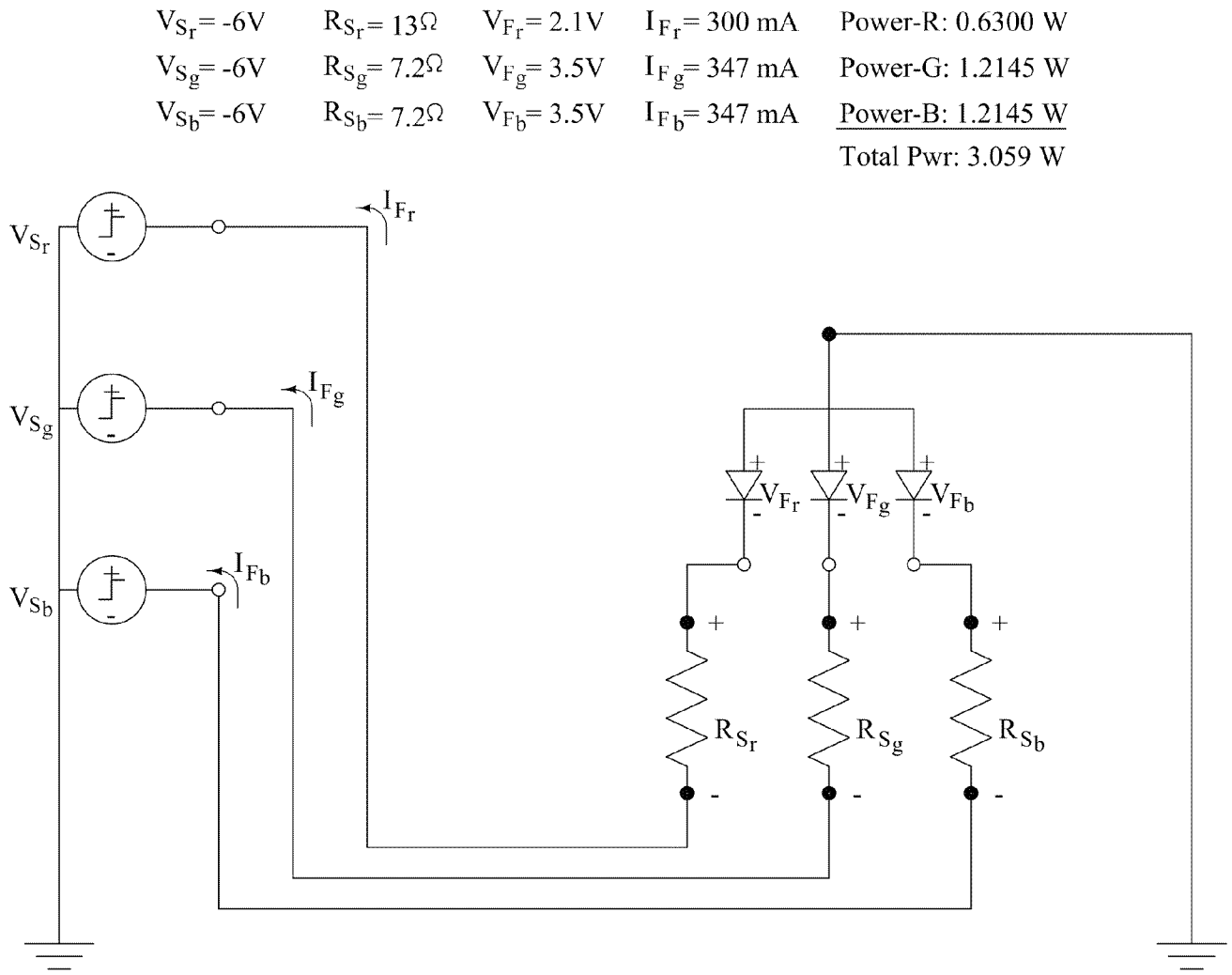
FIG. 7 is a circuit diagram for an addressable matrix of RGB-LEDs used in accordance with the present invention.

In constructing an addressable matrix of RGB-LEDs, a circuit is typically created, such as what is shown in FIG. 7, where each diode is placed in series with a source resistor ($R_s$) and is also connected to a voltage source ($V_s$). The voltage source provides a means of independently controlling the behavior of the individual LEDs, whereas the source resistors are used to limit the current that passes through the diodes, as LEDs are current-dependent devices. Values for the circuit component specifications used in an exemplary circuit are provided in FIG. 7.

As a further refinement to the lights 40 of the color changing display 10, and although the lights 40 have been described herein with reference to RGB-LEDs, it is contemplated that the lights 40 can be comprised of numerous other types of lights that are capable of transmitting different colors of light and transitioning between those different colors. Exemplary types of additional lights that may be used in accordance with the presently-disclosed subject matter include, but are not limited to, flashlights, fixed-lights with color changing bulbs, and the like. Additionally, it is contemplated that the lights 40 of the color changing device 10 can be positioned on various portions of the color changing display 10 to provide a color changing display that is back-lit, front-lit, or both back-lit and front-lit.

The above-described color changing display, which incorporates one or more lights to produce a color changing illumination and change the appearance of a combined image, can advantageously be used to display various combined images and make those images appear to change and/or become animated as the lights directed toward those images transition between different colors of the spectrum. As such, the presently-disclosed color changing display can be used in a number of applications in the fine art, entertainment, and advertising industries as an energy-efficient alternative to known displays and advertisements.

For example, a color changing display can be incorporated into a table or bar top such that the combined image of the display serves as the surface of the table or bar. Additionally, it is contemplated that a color changing display can be combined with indium tin oxide to produce a touch screen that provides a user with an interactive color changing display. As another example, it is contemplated that the color changing displays can be used to produce billboards containing fully addressable matrices of RGB-LEDs. It is further contemplated that the color changing displays can be incorporated into automobiles and other vehicles with clear or slightly opaque body paneling so as to affix various logos onto the panels and then illuminate them such that the logos and images become animated.

It is also contemplated that the concepts described herein above can be used to produce various color changing clothing and apparel wherein lights within the clothing or apparel are used to animate a combined image on the clothing. In this regard, clothing or various fabric materials, onto which combined images are digitally printed or sub-dye laminated and in which various lighting products (e.g., Organic Light Emitting Diode (OLED) screens or Phillips Lumalive® lighting technology (Philips Electronics N.V. LLC, Eindhoven, Netherlands)) are installed and/or integrated into, behind, or between the fabrics, can be created in a manner whereby light is projected through the fabric and onto the combined image to create the desired effect. Of course, such a technique can also be applied to numerous other types of fabric products including, but not limited to, hats, blankets, curtains, and the like.

Additionally, it is contemplated that a backpack can be made out of a clear or opaque diffusing plastic material that is semi-rigid or rigid in structure and includes RGB-LEDs, such that the RGB-LEDs are used to project light onto a combined image on the backpack and produce an animation on the surface of the backpack. As will be recognized by those skilled in the art, such a backpack can be used to display advertising, but may also be used to promote the safety and security of children or in crowded situations or during travel.

Finally, it is contemplated that shoes with integrated RGB-LEDs can be fabricated such that the light from the RGB-LEDs is projected onto clear or diffusing soles of the shoes that include a combined image.

Further provided, in some embodiments of the presently-disclosed subject matter, is a color changing bottle 110 that comprises: a bottle 120 having a compartment 130 positioned in a lower portion of the bottle 120; a light 140 secured within the compartment 130 for producing a color changing illumination; a light-transmitting substrate 150, the light-transmitting substrate 150 being attached to the bottle 120 such that the light transmitting substrate 150 surrounds at least a portion of the bottle 120; a combined image 160 comprising two or more images affixed to the light transmitting substrate 150 such that an appearance of the combined image 160 changes in response to different colors of light; a controller 170 secured within the compartment 130 for controlling the light 140; and a power supply 172 secured within the compartment 130 and connected to the controller 170.

Figure 8:
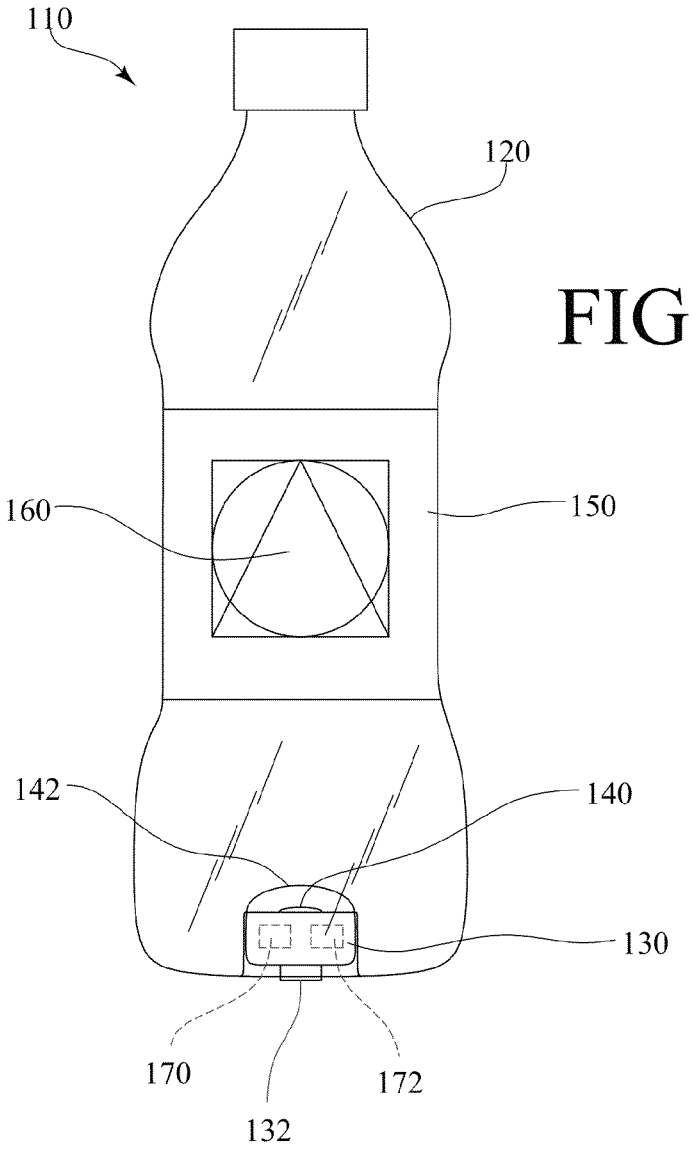
FIG. 8 is a front view of an exemplary color changing bottle made in accordance with the present invention.
Figure 9:
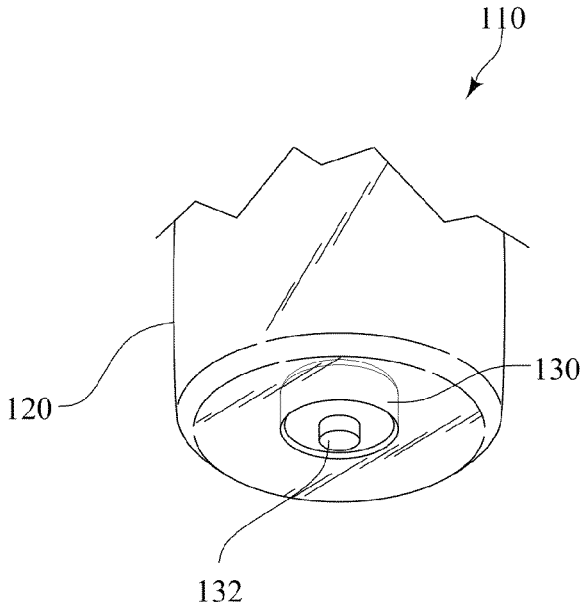
FIG. 9 is a photograph of a lower portion of an exemplary color changing bottle made in accordance with the present invention.

In some embodiments, and as shown in FIGS. 8 and 9, the color changing bottle 110 includes a single RGB-LED as the light 140 that is incorporated into the compartment 130 at the lower portion of the bottle 120 along with the controller 170 (e.g., a micro-controller), the power supply 172 (e.g., batteries), and a switch 132. A magnifier 142 is further installed above the bulb of the RGB-LED such that the light from the RGB-LED is projected through the magnifier and upward into the body of the bottle 120 to illuminate the contents of the bottle 120 and further illuminate the light-transmitting substrate 150 (e.g., an externally attached label) that includes the combined image 160. Once the light contacts the combined image 160, a multitude of seemingly holographic and/or animated images is then produced, as described herein above.

In some embodiments, an exemplary color changing bottle can be molded from glass or plastic such that an internal magnifier and a compartment for the lights and their accompanying components is formed during the molding process. In such an embodiment, the light can be affixed upright in the bottle such that the light projects through the bottle itself, and the switch can be positioned on the bottom of the bottle to allow the lights to be easily turned on or off or set to perform a specific function (i.e., a program where different colors of lights are illuminated and fade in turn). In some embodiments, where the switch 132 is positioned on the bottom of the bottle, setting the bottle down on a surface operates the switch 132 and causes the light to turn on or off.

In yet further embodiments of an exemplary color changing bottle, the bottle can further include a molded or printed bottle cap that can be embossed or printed with a desired image. When the light in these bottles is turned on and projected throughout the bottle, the light can then penetrate through and project the cap image onto a surface. For example, when an exemplary bottle is placed on a table and the light is turned on, the logo can be projected on a ceiling above the bottle.

As yet another refinement, in some embodiments of the presently-disclosed subject matter, a color changing vending machine is provided that comprises a vending machine having a light-transmitting display surface; one or more lights secured in an interior portion of the vending machine for producing a color changing illumination; a combined image comprising two or more images affixed to the light-transmitting display surface such that the appearance of the combined image changes in response to different colors of lights; a controller for controlling the one or more lights; and a power supply connected to the controller.

To construct an exemplary color changing vending machine in accordance with the presently-disclosed subject matter, a vending machine, such as a standard beverage vending machine, can first be obtained and the front display of the machine can be removed to allow the lighting inside of the machine to then be removed as well. Then, one or more strips of RGB-LEDs can be installed around the edges of the display front, or otherwise mounted inside the display, and angled slightly toward the front of the machine (similar to the lights of the color changing display described herein above) such that the lights will shine directly upon the front of the display and animate a combined image that is affixed to the display in place of the standard vending machine or beverage company logo or promotional image. Of course, a controller and power supply for the lights can readily be included in such a machine and adapted for use with a wide variety of lighting options that can be used in place of the RGB-LEDs. Additionally, the lights included in an exemplary vending machine can also be arranged in a matrix (e.g., a matrix of RGB-LEDs) such that each light is addressable and the color of each light can be controlled independently within each vending machine. Furthermore, it is contemplated that color changing lights can be integrated into the machine in other locations, such as behind the buttons or around the beverage dispensing area, and used with a combined image to create an aesthetically pleasing animated effect on other areas of the vending machine.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A color changing display, comprising:

a frame structure having an inner surface, an outer surface, a front edge defining an open front portion of the frame structure, and a back edge defining an open back portion of the frame structure;

a panel having a front surface and a back surface, the panel being attached to the back edge of the frame structure such that the panel covers the open back portion of the frame structure;

one or more lights secured to the inner surface of the frame structure, the front surface of the panel, or both, the one or more lights for producing different light colors;

a controller secured to the frame structure or the panel, the controller configured to control the one or more lights to provide a smooth transition between the different light colors;

a light-transmitting substrate, the light-transmitting substrate being attached to the front edge of the frame structure such that the light-transmitting substrate covers the open front portion of the frame structure; and a combined image comprising two or more images printed in a single layer and affixed to the light-transmitting substrate, the images being different colors, each of the different colors layers reacting with a respective color of the different light colors such that an appearance of the combined image changes gradually from a first display image having one particular shape into a second display image having a second particular shape in response to the different light colors interacting with the combined image to produce a moving, seemingly holographic effect.

2. The color changing display of claim 1, further comprising a power supply secured to the front surface of the panel and connected to the controller.

3. The color changing display of claim 1, wherein the one or more lights are mounted at an angle in the color changing display such that the light being emitted is directed toward a desired portion of the light-transmitting substrate.

4. The color changing display of claim 3, further comprising a mounting lip secured around the inner surface of the frame structure and the front surface of the panel for mounting the one or more lights.

5. The color changing display of claim 1, wherein the light-transmitting substrate is comprised of a material selected from the group consisting of: paper, glass, translucent vinyl, and plexiglass.

6. The color changing display of claim 5, wherein the light-transmitting substrate is capable of diffuse transmission.

7. The color changing display of claim 1, wherein the one or more lights comprise a red light, a green light, and a blue light.

8. The color changing display of claim 7, wherein the one or more lights comprise a red-green-blue light-emitting diode (RGB-LED).

9. The color changing display of claim 8, wherein the RGB-LEDs are arranged in strips of RGB-LEDs.

10. The color changing display of claim 9, wherein the color changing display includes two strips of RGB-LEDs arranged in two rows around the inner surface of the frame structure.

11. The color changing display of claim 8, wherein the one or more lights are addressable.

12. The color changing display of claim 8, wherein the one or more lights are arranged in a matrix.

13. The color changing display of claim 1, wherein the different color images comprise different pigment colors, and wherein each of the different pigment colors reflects a respective color of light and absorbs other colors of light to produce the moving, seemingly holographic, effect as the different light colors transition from color to color.

14. The color changing display of claim 13, wherein the combined images includes an area of green pigment, wherein when the one or more lights produce a green light, the area of green pigment will reflect the green light and appear as green, and when the one or more lights produce one of a blue light and a red light, the area of green pigment will absorb the one of the blue light and the red light and appear as black.

15. The color changing display of claim 14, wherein the combined image further includes an area of red pigment and an area of blue pigment, wherein when the one or more lights produce a red light, the area of red pigment will reflect the red light and appear as red and the area of green pigment and the area of blue pigment will absorb the red light and appear as black; and wherein when the one or more lights produce a blue light, the area of blue pigment will reflect the blue light and appear as blue and the area of green pigment and the area of red pigment will absorb the blue light and appear as black.

16. A color changing vending machine, comprising:

a vending machine including:

a frame structure having an inner surface, an outer surface, a front edge defining an open front portion of the frame structure, and a back edge defining an open back portion of the frame structure;

a panel having a front surface and a back surface, the panel being attached to the back edge of the frame structure such that the panel covers the open back portion of the frame structure;

one or more lights secured to the inner surface of the frame structure, the front surface of the panel, or both for producing different light colors;

a controller secured to the frame structure or the panel, the controller configured to control the one or more lights to provide a smooth transition between the different light colors;

a light-transmitting display surface attached to the front edge of the frame structure such that the light-transmitting display surface covers the open front portion of the frame structure; and a combined image comprising two or more images printed in a single layer and affixed to the light-transmitting display surface, the images being different colors, each of the different color images reacting with a respective color of the different light colors, such that an appearance of the combined image changes gradually from a first display image having one particular shape into a second display image having a second particular shape in response to the different light colors interacting with the combined image to produce a moving, seemingly holographic, effect.

* * * * *

UNITED STATES PATENT AND TRADEMARK OFFICE

CERTIFICATE OF CORRECTION

PATENT NO. : 9,064,433 B2
APPLICATION NO. : 13/169648
DATED : June 23, 2015
INVENTOR(S) : Nicholas L. Jumblatt and Eric W. Francke It is certified that error appears in the above-identified patent and that said Letters Patent is hereby corrected as shown below:

In the Claims,

Claim 1, col. 10, line 64, delete “colors layers” and replace with “color images”.

Signed and Sealed this
Twenty-fourth Day of November, 2015

Michelle K. Lee

Michelle K. Lee
*Director of the United States Patent and Trademark Office*